United States Patent [19]

Bartmann

[11] 4,304,368

[45] Dec. 8, 1981

[54] METHOD AND TWO-DRUM WINDER FOR THE WINDING OF ENDLESSLY FED WEBS

[75] Inventor: Bernhard Bartmann, Heidenheim, Fed. Rep. of Germany

[73] Assignee: J. M. Voith GmbH, Fed. Rep. of Germany

[21] Appl. No.: 129,675

[22] Filed: Mar. 12, 1980

[30] Foreign Application Priority Data

Mar. 13, 1979 [DE] Fed. Rep. of Germany ..... 2909736

[51] Int. Cl.[3] ..... B65H 19/20

[52] U.S. Cl. ..... 242/56 R; 242/66

[58] Field of Search ..... 242/66, 56 R, 65

[56] References Cited

U.S. PATENT DOCUMENTS

| | | | |
|---|---|---|---|
| 817,026 | 4/1906 | White | 242/66 |
| 2,989,262 | 6/1961 | Hornbostel | 242/56 R |
| 3,539,125 | 11/1970 | Patriksson | 242/56 R |
| 3,592,403 | 7/1971 | Schmitt | 242/56 R |
| 3,869,095 | 3/1975 | Diltz | 242/66 |

*Primary Examiner*—Edward J. McCarthy

*Attorney, Agent, or Firm*—Ostrolenk, Faber, Gerb & Soffen

[57] ABSTRACT

The disclosure concerns a two-drum winder for the winding of an endlessly fed web. Two parallel carrier drums define a carrier drum bed in which a roll to be wound is supported. Upon completion of winding of a roll, the roll is lifted, a web cutting device presses the web against the raised wound roll, air is blown in the feed direction of the web for forming a loop of the web over the second carrier drum in the feed direction. Additional air is directed up between the carrier drums for assisting in the loop formation. A pressing roller on the cutting device presses the loop against the second carrier drum and continued rotation of the second carrier drum draws the looped web tight against a knife in the cutting device for cutting the web. The newly leading end of the web continues to be blown by the loop forming air flow which flattens the web. Then an air flow blows the newly cut leading end of the web counter to the web feed direction onto a new winding core supported in the carrier bed. Another pressing roll presses the web against the first carrier drum in the feed direction for preventing slipping of the web as the loop is formed and as the web is cut.

24 Claims, 4 Drawing Figures

METHOD AND TWO-DRUM WINDER FOR THE WINDING OF ENDLESSLY FED WEBS

BACKGROUND OF THE INVENTION

The present invention relates to a method and to a two-drum winder for the winding of endlessly fed webs, and particularly webs of paper from roll slitting machines, with the formation of individual wound rolls.

The individual wound rolls lie on two carrier drums, arranged parallel to each other, i.e. an arriving first carrier drum and a departing second carrier drum with respect to the wound roll located in the carrier drum bed thereof and the roll is driven by the drums during the winding process. Then the completely wound roll is lifted off and the web is pressed at a first holding point against the wound roll and at a second holding point against one of the two carrier drums. The web is then stretched over a knife between the two holding points and thereby cut off. The finished wound roll is now removed, and the starting end of the new web is driven back in the direction opposite the web feed direction by means of compressed air and it is taken up by a new winding core which has been made ready, and wound up.

This type of web winding is known from Austrian Pat. No. 332,214, which corresponds to U.S. Pat. No. 3,841,578. There the web travels upward from below between the carrier drums and onto the roll to be wound. The web wraps around a part of the second carrier drum as seen in the direction of winding. The new winding core is, however, not placed on top of the carrier drums but is applied from below to the carrier drums and is pre-wound there. Thereupon the two carrier drums are moved apart, the pre-wound winding core is brought upward into the carrier-drum bed and the two carrier drums are again brought to the required narrow distance from each other. Since the carrier drums are several meters long and are normally also driven, this means an expensive construction. Furthermore, glue must be applied to the web so that the end of the new web produced by the cutting process is in each case taken up by the new winding core and is wound. Nevertheless, the starting end of the newly cut web may undesirably not remain attached to the new winding core, but may instead slide away downward past the new winding core.

U.S. Pat. No. 3,918,654 shows a double-drum winder in which the web is not passed upward from below between the carrier drums but is instead conducted over the two drums. The new winding core is in each case applied from above onto the web and is pressed together with the web into the drum bed. In this case also, gluing of the web of paper is necessary so that it be grasped by the new winding core and then wound. After completion of a wound roll, the web is cut by a knife that is pushed through the section of the web in the upward direction between the two drums. The web is moved, between the two drums, around the lower section of the new winding core. Only a small amount of space is available for the knife between the drums and the device for the actuation of the knife is complicated. Furthermore, the knife must also be frequently replaced since it can cut the web on the winding core only when it is extremely sharp. Furthermore, there is also the danger that, despite the gluing, the starting end of the new web will not be wound by the winding core, but will instead move away. In addition to this, with both of the known methods and the double-drum rollers, there is a danger that the carrier drums and the web of paper being dirtied by glue so that the web will remain stuck in undesired fashion in the machine and will be damaged.

SUMMARY OF THE INVENTION

The object of the present invention is to effect the replacement of wound rolls in structurally simple manner without interference and in automatic fashion.

The invention permits the carrier drums to remain in their original position without change. The new winding core is in each case brought directly onto the carrier drums in the carrier-drum bed. The starting end of the new web, which is produced by the cutting process is conducted by compressed air around a part of the new winding core and into the feed slot which is formed between the winding core and the following section of web. In this way, it is no longer possible for the starting end of the web to veer away from the new winding core. The entire change of rolls can be effected automatically. Similarly, the introduction of the new winding cores can also take place automatically when an automatic winding-core feed device is arranged in known manner at the end of the double-drum winder.

The invention is particularly well-suited for winding cores which have been pushed in the form of tubes over flexurally rigid winding rods.

The web of paper continuously produced by a paper making machine may, for instance, be 9 m wide. This wide web is cut by a roll slitting machine into several narrow webs. These narrower webs are wound into individual wound rolls in a double-drum winder of the type described here. In this connection, the two drums normally carry, alongside of each other, at the same time, as many winding rolls as the number of webs cut by the roll slitting machine. After the individual wound rolls have reached the desired diameter, they must be removed, insofar as possible, without any loss of time and the individual web must be separated from the wound rolls and be brought to new winding cores which have already been made available.

In accordance with the invention, after the completion of a winding process, the roll slitting machine and the double drum winder are stopped. A pressure roll is swung against the first carrier drum in order to hold the web fast. The completely wound roll is lifted and a cutting head, which is rotatably supported on the second carrier drum, is swung up to the finished wound roll.

With feed speed and with connected blow pipes on the pressing roll and in the drum nip, the web is blown so far between the cutting head and the second drum that a loop of web of a given length is formed. Thereupon, one or more rolls, supported in the cutting head, are swung against the second carrier drum. Next, a slitting knife is pushed from the cutting head into the web which is stretched tightly over the cutting head. Cutting of the web is thereby effected. For removal of the loop, the rolls supported in the cutting head are swung away briefly and a blow pipe which is present at the first carrier drum blows the web over the second carrier drum so that the starting end of the new web produced by the cutting of the web comes to lie over another blow pipe which is arranged, fixed in position, in front of the second carrier drum. Thereupon, the blow pipe arranged at the first drum is disconnected together with the roll slitting machine, and the cutting head with rollers resting against the second carrier drum passes back into the ready position. The newly cut web lies between the second carrier drum and the rollers of the cutting head.

After the removal of the finished wound roll and the insertion of the new winding core or of a winding rod provided with winding tubes into the drum bed, a pressure drum which was holding the web to the first carrier drum is swung away from the first carrier drum and the rolls provided on the cutting head are swung away from the second carrier drum so that the further blow pipe which is now connected blows the web upward in front of the second carrier drum, and blow nozzles present in the cutting head conduct the web over the winding core when the cutting head is briefly swung upward, in order to assist in the placement of the starting end of the new web around the new winding core. Thereupon, the blow pipe arranged in front of the second carrier drum and the blow nozzles present in the cutting head are disconnected and the cutting head is moved back into its ready position. A new winding process can now be started.

Other objects and features of the invention will be apparent from the following description considered with reference to the drawings:

DESCRIPTION OF THE PREFERRED EMBODIMENTS

Figure 1:
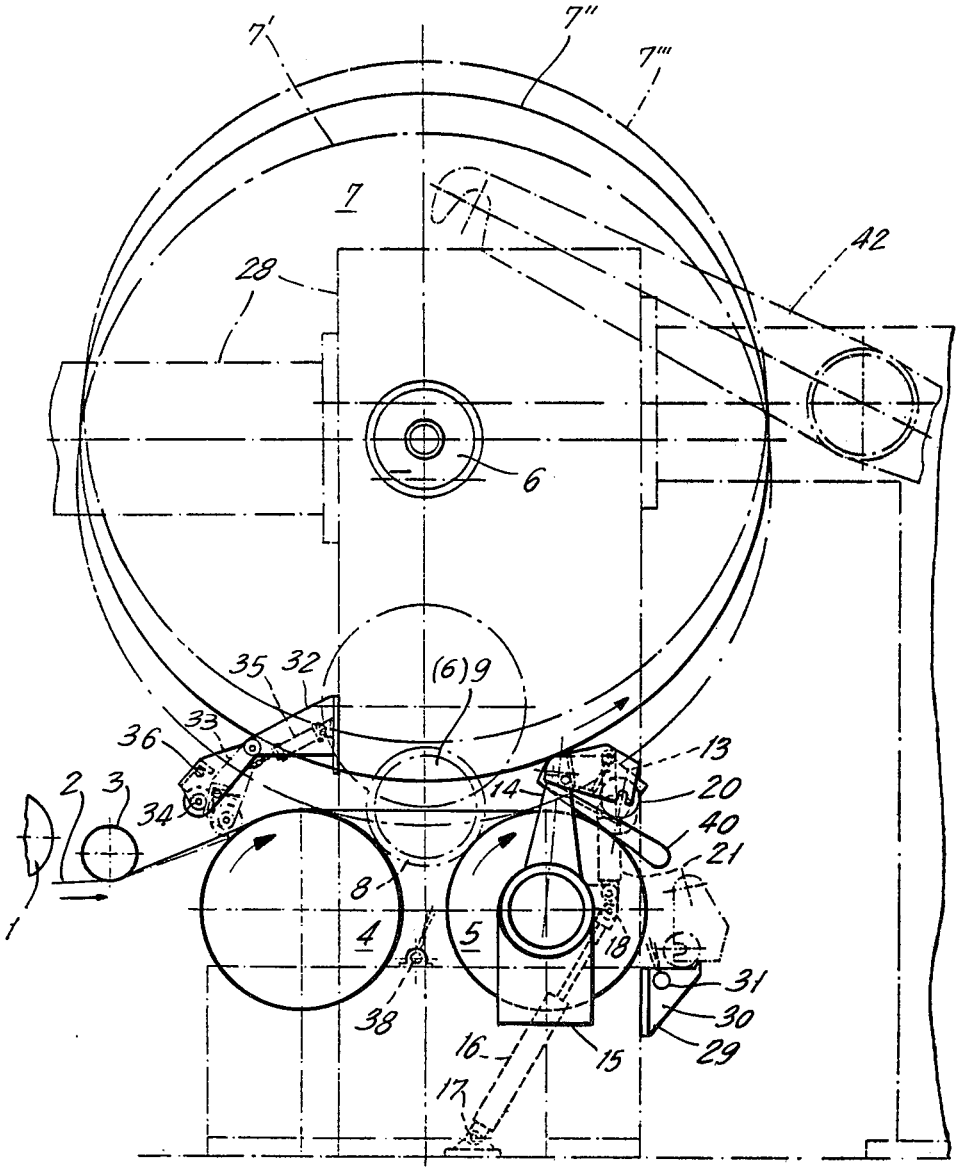
FIG. 1 is a diagrammatic side view of a double drum winder in accordance with the invention.
Figure 2:
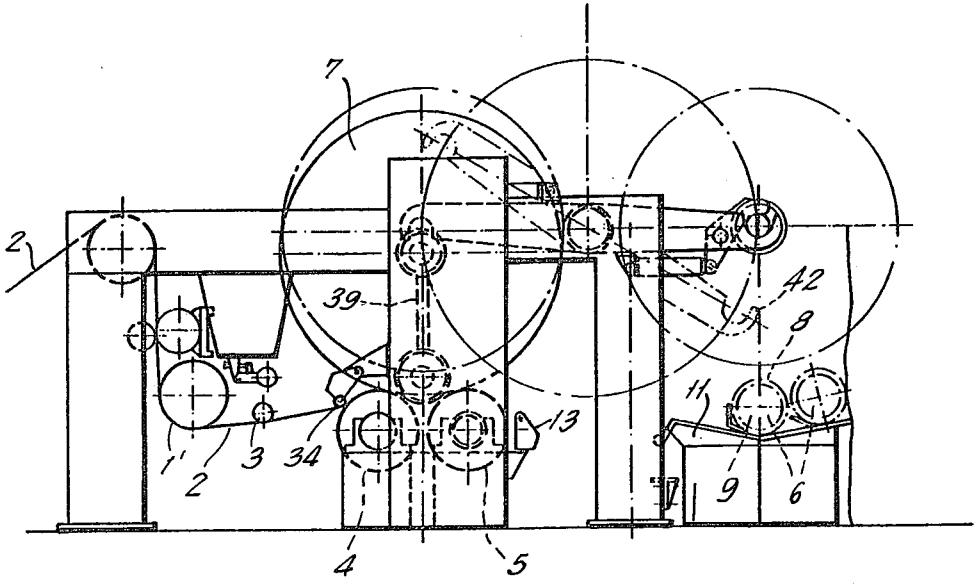
FIG. 2 is a side view of this double drum winder, shown together with a roll slitting machine and a tube insertion device.
Figure 3:
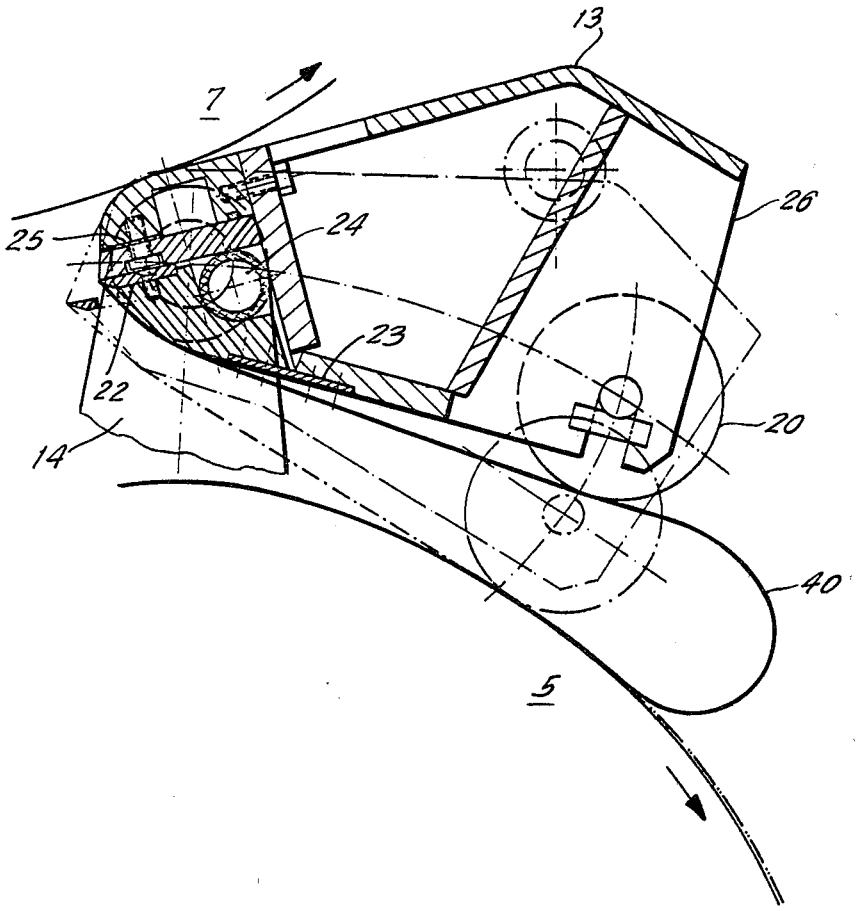
FIG. 3 is an enlarged sectional view of the cutting device.
Figure 4:
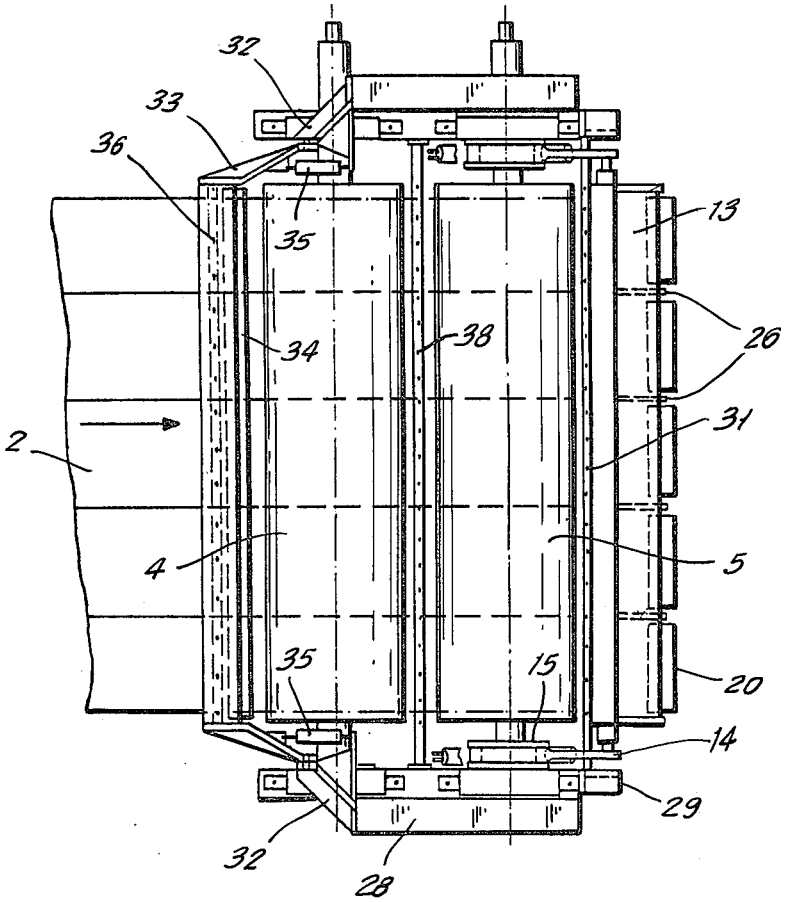
FIG. 4 is a diagrammatic top view of the double drum winder of FIG. 1.

There is a roll slitting machine 1, only a part of a guide roller of which is visible in FIG. 1. The web 2 which is to be wound passes from the slitting machine 1 over another guide roller 3 onto the top portion of the first carrier drum 4 and from there it passes onto the top portion of the second carrier drum 5. From the drum 5, the web is returned in the direction counter to its feed direction and is then wound on a winding core 6 lying in the drum bed above and between the drums 4 and 5 and on top of the web 2 so that a wound roll 7 is formed on the core. At least one of the two carrier drums 4 and 5 is driven and thereby turns the winding core 6 and the wound roll 7 that is formed on the core.

Normally, several webs 2 travel simultaneously alongside each other on the carrier drums 4, 5 and are wound there onto winding cores 6. In this connection, the winding cores 6 are normally comprised of winding tubes 8 which are placed over a flexurally rigid winding rod 9. The winding rod 9 together with the winding tubes 8 is, in case of automatic operation, automatically taken from a tube insertion device 11 and placed into the drum bed of the carrier drums 4 and 5.

A cutting or separating device 13, is supported by means of swingable supporting levers 14 located on both sides in collar bearings 15 which are arranged on the second carrier drum, whereby the axis of swing of the cutting device, which swinging occurs on the levers 14, coincided with the rotation axis of the second carrier drum.

The cutting device 13 with the supporting levers 14 can be swung around the axis of the drum 5 by cylinders 16, which are rotatably supported by bearing brackets 17 on the floor and by forked heads 18 on the supporting levers 14.

In the cutting device 13, a plurality of pressing rolls 20 are supported in an axial array, one behind the other, in a row parallel to the arrays of carrier drums 4 and 5. Movement of the rolls 20 of the cutting device 13 against and away from the second carrier drum 5 is effected by means of cylinders 21 which are rotatably supported between the supporting levers 14 and the cutting device 13.

Ribs 26 are provided for supporting of the rolls 20 in the cutting device 13.

Holding brackets 29 arranged on both sides on stands 28, receive the cutting device 13 in the ready position.

A knife or cutting blade 22 is suspended from the cutting device 13 in an elastically swingable manner by means of a spring plate 23. The knife 22 can be swung by inflation of an inflatable hose 24 to protrude from the cutting device into the path of the web 2 and can be swung back again to retract into the cutting device by the initial tension of the spring plate 23. Instead of an inflatable hose 24, a hydraulic expansion element could also be employed. Within the basic body of the cutting device 13, there is an air chamber with blow nozzles 25 which serves as a blowing device. The nozzles of this blowing device are directed toward the web, back toward the feed direction of the web and are directed between the wound roll 7 and the pressing rolls 20. These nozzles assist in directing the end of the cut web onto a new core.

Between holding brackets 30 a blow pipe 31 is supported. Its nozzles are directed opposite the direction of rotation of the second carrier drum 5 and it also serves as a blowing device. It is the principal means for directing the cut end of the web onto a new core 6.

A cross member 33 is swingably supported on brackets 32. In the cross member 33, there is rotatably supported a pressure drum 34. By means of cylinders 35 the cross member can be swung, enabling the pressure drum 34 to be placed against the first carrier drum 4. In this way, the web of paper 2 can be held fast between the pressure drum 34 and the first carrier drum 4 and the web can be prevented from sliding out or rearwardly.

Furthermore, a blow pipe 36 is provided on the cross member 33. Its nozzles are so directed that they can blow a stream of air through the space between the two carrier drums 4 and 5, on the one hand, and the wound roll 7 and the cutting device 13, on the other hand. This too serves as a blowing device. The blow pipe 36 blows against the web which is then being held against the wound roll 7 by the cutting device for forming a loop 40 of the web.

There is a blow pipe 38 arranged between the two carrier drums 4 and 5 and below the web 2. It has upwardly directed nozzles which, during the replacement of the cores, give off a stream of air against the bottom of the web 2 and thereby, together with the stream of air from the blow pipe 36, guide the web in the direction of movement of the web, as will be further described below. The blow pipe 38 is yet another blowing device.

The apparatus of the invention operates as follows. After completion of a wound roll 7, the roll slitting machine 1 and the double drum winder are stopped.

Then the pressure drum 34 together with the blow pipe 36 are swung against and press upon the first carrier drum 4. The pressure drum 34 holds the web 2 firmly on the first carrier drum 4 so that it cannot slide backward upon the subsequent cutting of the web. The wound roll 7 is then lifted by a known lifting device 39 from the lower position 7' to the upraised position 7'' so that a space is produced between the wound roll 7 and the two carrier drums 4 and 5 on which the roll had previously sat. The cutting device 13 is now swung against the wound roll 7. The roll slitting machine and the double drum winder are then again connected and operate with a predetermined speed. The web is thus being fed again. At the same time, the blow pipes 36 and 38 are actuated so that as the web 2 is being fed, it is also being blown between the cutting device 13 and second carrier drum 5, thereby producing a web loop 40.

When a given length of the loop 40 is produced, the rollers 20 of the cutting device 13 are swung against the second carrier drum 5 and the knife 22 is moved into the stretched web 2. The rotating carrier drum 5 pulls the web loop tight against the protruding knife while the cutting device holds the web against the roll 7. Once the web has been cut, the knife 22 thereupon retracts into its starting position. The rolls 20 of the cutting device 13 are again moved away from the second carrier drum 5 and are held spaced from it and the continued blowing by the blow pipe 36 eliminates the loop 40 and the web 2 comes to lie above the carrier drum 5 and above the blow pipe 31. Then the blow pipe 36 is disconnected, together with the roll slitting machine and the double-drum winder.

The cutting device 13 then moves into the ready position, its dot-dash line position. The rolls 20 supported on it are held still against the carrier drum 5 for the time being. In this way, the rolls 20 continue to hold the web 2 fast against the carrier drum 5.

After the wound roll 7 has been lifted to the further upraised position 7''' and has then been removed from the position 7''' by a known changing device 42 and after the changing device 42 has taken a new winding core 6 from the tube insertion device 10 and placed it into a lifting device 39, the pressure drum 34 is lifted from the first carrier drum 4.

Then the rolls 20 are swung away from the second carrier drum 5, and the blow pipe 31 is connected, so that it blows the starting end of the new web, that was produced by the cutting device, upward. Furthermore, the cutting device 13 is swung upward so that its blowing device 25 assists the blow pipe 31, and the web is conducted over the new winding core 6 which the lifting device 39 has in the meantime lowered into the drum bed of the two drums 4 and 5.

The cutting device 13 is shown in solid line in operating position in FIG. 1. Furthermore it is shown in dot-dash line in its ready position. The operating position that exists when the rollers 20 rest against the second carrier drum 5 is indicated by dashed lines.

Upon the disconnecting of the blow pipe 31 and of the blow device 25 of the cutting device 13, the cutting device 13 is again swung into the ready position. The swinging of the cutting device 13 is around the pivot point of the second carrier drum 5.

The double drum winder is now ready to start a new winding process.

Although the present invention has been described in connection with a preferred embodiment thereof, many variations and modifications will now become apparent to those skilled in the art. It is preferred, therefore, that the present invention be limited not by the specific disclosure herein, but only by the appended claims.

What is claimed is:

1. A method of winding an endless fed web, wherein an individual wound roll that is wound with the web is supported on and between two parallel carrier drums and the wound roller is supported in the carrier drum bed defined between the carrier drum and wherein the carrier drums comprise a first carrier drum in the feed direction of the web followed by a second carrier drum in the feed direction of the web, and wherein the wound roll is driven by the carrier drums during winding of the web on the wound roll, the method comprising the steps of:

raising the wound roll off the carrier drums; pressing the web at a first holding point against the wound roll; while continuing to feed the web past the first holding point and over the first and second carrier drums, shaping the oncoming web into a loop which extends in the direction of feed of the web and over part of the second carrier drum;

pressing the web loop against the second carrier drum at a second holding point, and rotating the second carrier drum, whereby the web is carried along by the second carrier drum, and the carrying along of the web by the second carrier drum stretching the loop over a knife located between the second holding point and the first holding point for cutting the web on the knife and for defining a newly cut leading end of the web;

removing the wound roll after the web has been cut; introducing a new core into the carrier drum bed on which core a new roll of the web is to be wound;

blowing the newly cut leading end of the web in a direction opposite the feed direction of the web for placing that end around a part of the new core.

2. The method of winding a web of claim 1, further comprising the step of holdng the web at a third holding point against the first carrier drum while the wound roll is being raised and while the loop is being cut.

3. The method of winding a web of claim 1, wherein the shaping of the web into a loop comprises blowing air between the raised wound roll and the section of the web that is beneath the raised wound roll, and the blowing of air being substantially in the feed direction of the oncoming web, for forming a loop in the oncoming web, which loop extends in the direction of feed of the web.

4. The method of winding a web of claim 3, further comprising during the shaping of the web loop, blowing air up between the carrier drums and against the lower side of the web for aiding in the formation of the loop.

5. The method of winding a web of either of claims 3 or 4, further comprising following the cutting of the web, continuing to blow that air that shaped the web into a loop against the web in order to eliminate the loop in the cut web and to blow the newly cut leading end of the web in the feed direction for placing the newly cut leading end of the web in a position to be blown for placement around a part of the new core.

6. The method of winding a web of either of claims 1 or 3, wherein the blowing of the newly cut end of the web comprises blowing the newly cut end using a fixed source of compressed air which blows the end of the web toward the new core and also using a movable source of compressed air, wherein the movable source of compressed air is moved in a direction that is opposite the feed direction of the web, for moving the newly cut leading end of the web in a direction opposite the feed direction of the web and for moving it to the new core.

7. The method of winding a web of claim 5, wherein the blowing of the newly cut end of the web in the direction opposite the feed direction of the web follows after the blowing of the air that shaped the web into a loop and follows after the continued blowing of the newly cut leading end of the web by the air that shaped the web into a loop and which eliminates the loop.

8. The method of winding a web of claim 3, wherein the web is first guided onto the first carrier drum in the feed direction and is then guided onto the second carrier drum in the feed direction, and the web rests on the upper portions of the first and second carrier drums.

9. A drum winder for winding an endlessly fed web, comprising:

two parallel carrier drums; means for supporting and for rotating the drums;

means for feeding an endless web to the drums, with one of the drums being first in the feed direction of the web and with the other drum being second in the feed direction of the web; the drums together and between them defining a carrier drum bed, wherein a wound roll of the web is carried in the carrier drum bed and wherein a new core on which a wound roll is to be formed is to be carried in the carrier bed; the web feeding means being for feeding the web over the carrier drums to the roll being wound;

a lifting and a removing device for the finished wound roll; an installation device for installing a new core on which a roll is to be wound in the carrier bed;

a knife positioned between the raised wound roll and the carrier drums and positioned for cutting the web when it is stretched between the wound roll and the second carrier drum;

a first blowing device for blowing the leading end of the newly cut web around a newly installed winding core placed at the carrier bed;

a first pressing device for pressing the web against the wound roll, prior to lifting and removal of the wound by the lifting and removing device;

a second blowing device for blowing a stream of air substantially in the feed direction of the web and into the space defined between the carrier drums, on the one hand, and the raised wound roll and the first pressing device, on the other hand, and the second blowing device being for forming a loop of the web;

a second pressing device for pressing the formed loop of the web against the second carrier drum, such that continued rotation of the second carrier drum moves the loop past the second pressing device and eventually tightens the loop against the knife, whereby as the second carrier drum moves the web, it tensions the web over the knife for causing the knife to cut the web.

10. The drum winder of claim 9, wherein the first pressing device and the knife comprise parts of a single unit that is a cutting device and which shifts together with respect to the wound roll on the carrier bed.

11. The drum winder of either of claims 9 or 10, wherein the first pressing device and the first blowing device comprise parts of a single unit which shifts together with respect to the wound roll, and the first blowing device is aimed to blow substantially in the direction opposite the feed direction of the web as the web is fed past the carrier drums.

12. The drum winder of claim 11, wherein the first blowing device further includes means for blowing air through a space between the second carrier drum and the knife and in a direction opposite the feed direction of the web.

13. The drum winder of claim 10, wherein the first blowing device includes means for blowing air through a space between the second carrier drum and the knife and in a direction opposite the feed direction of the web.

14. The drum winder of either of claims 9 or 13, further comprising a third blowing device for blowing air between the carrier drums and against the side of the web which lies against the carrier drums for assisting the second blowing device in defining a loop in the web.

15. The drum winder of claim 9, further comprising a third pressing device for pressing the web against the first carrier drum, for holding the web against the first carrier drum.

16. The drum winder of claim 9, further comprising guides for conducting the web first onto the first carrier drum and then onto the second carrier drum and such that the web contacts the upper portions of the carrier drums.

17. The drum winder of claim 10, wherein the cutting device has an axis of swing which coincides with the rotation axis of the second carrier drum for shifting the cutting device between the position where the first pressing device presses the web against the wound roll and a position where the first pressing device is away from the wound roll.

18. The drum winder of claim 10, wherein the first blowing device is, at least in part, arranged on the cutting device and blows air in a direction opposite the feed direction of the web over the second carrier drum.

19. The drum winder of claim 9, further comprising a cutting device of which the knife is a part; the cutting device includes means for causing the knife to protrude from the cutting device and for enabling the knife to cut the web and means for causing the knife to retract into the cutting device.

20. The drum winder of claim 19, wherein the means for causing the knife to retract into the cutting device comprises spring means connected with the knife.

21. The drum winder of claim 20, wherein the spring means comprises a spring plate which defines a swing axis for the knife.

22. The drum winder of claim 21, wherein the means for causing the knife to protrude from the cutting device comprises an inflatable hose arranged parallel to the axis of swing of the knife, and the inflation of the hose urges the knife to protrude.

23. The drum winder of claim 19, wherein the means for causing the knife to protrude from the cutting device comprises an inflatable hose, the inflation of which urges the knife to protrude.

24. The drum winder of claim 10, wherein the second pressing device is also a part of the cutting device and the cutting device includes means for moving the second pressing device toward the second carrier drum and away therefrom.

* * * * *